United States Patent [19]

Miller

[11] Patent Number: 4,497,989

[45] Date of Patent: Feb. 5, 1985

[54] ELECTRIC MAT SWITCH

[76] Inventor: Norman K. Miller, Concord Industrial Park, Concordville, Pa. 19331

[21] Appl. No.: 572,589

[22] Filed: Jan. 20, 1984

[51] Int. Cl.[3] ..... H01H 3/14

[52] U.S. Cl. ..... 200/86 R; 200/86.5

[58] Field of Search ..... 200/86 R, 86.5; 340/666; 307/119

[56] References Cited

U.S. PATENT DOCUMENTS

| | | | |
|---|---|---|---|
| 1,776,992 | 9/1930 | Brockman | 200/86 R |
| 3,243,540 | 9/1966 | Miller | 200/86 R |
| 4,137,116 | 1/1979 | Miller | 200/86 R |

FOREIGN PATENT DOCUMENTS

| | | | |
|---|---|---|---|
| 968211 | 9/1964 | United Kingdom | 340/666 |

*Primary Examiner*—A. D. Pellinen

*Assistant Examiner*—Morris Ginsburg

*Attorney, Agent, or Firm*—Robert K. Youtie

[57] ABSTRACT

An electric mat switch including a pair of outer wear layers, a pair of inner moisture barrier layers between the wear layers and a separator layer between the moisture barrier layers; all of which layers are substantially congruent and sealed together about their peripheral margins as by heat sealing, radio frequency welding or the like; and a pair of conductor layers each located between the separator layer and a respective barrier layer and spaced inwardly from the sealed margins; the separator layer being resiliently compressible and openly configured for flexure therethrough of the conductor layers into contact with each other.

12 Claims, 3 Drawing Figures

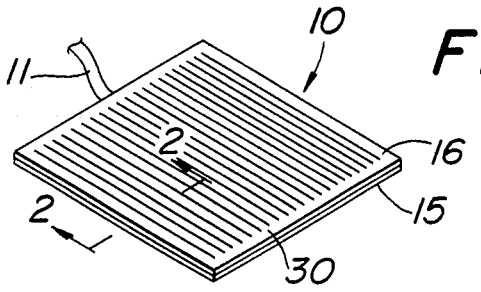
FIG. 1
FIG. 2
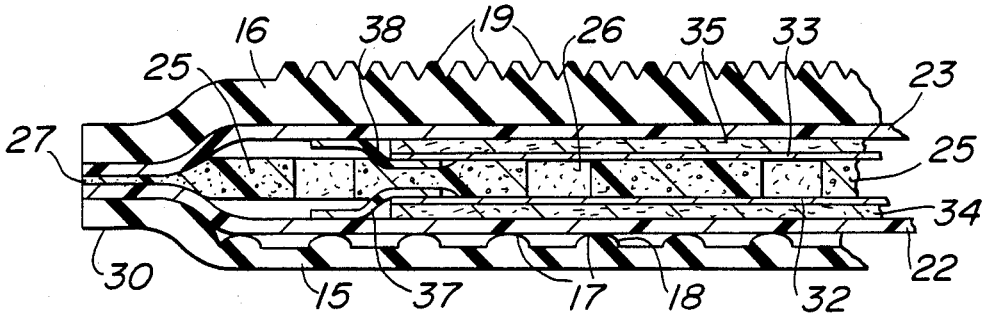
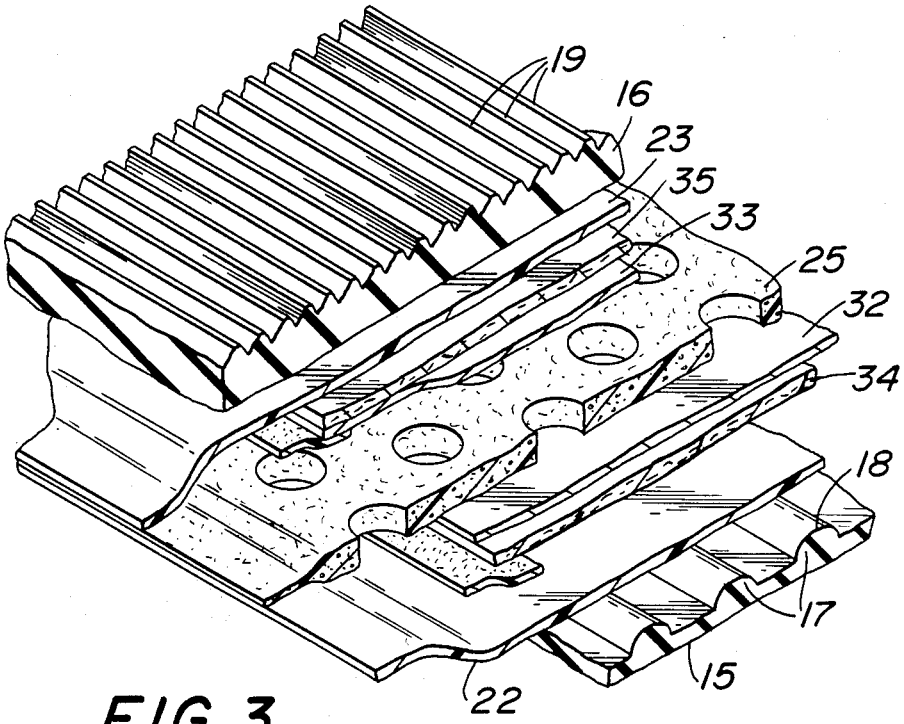
FIG. 3

ELECTRIC MAT SWITCH

BACKGROUND OF THE INVENTION

The electric mat switch of the present invention is concerned with treadles and floor mat devices responsive to persons walking, stepping or dropping articles on the mat for closing a switch in an electric circuit. Such devices are commonly used in conjunction with machines to shut down the same upon personnel movement toward the machine over the mat; in doorways and passages for signaling and actuating alarms, and other desired locations.

Heretofore, electric floor mat switches of this general type required very careful handling in storage, shipment and use to maintain the desired sensitivity of operation while preventing inadvertent damage resulting in switch closure or short circuiting. Toward this end, the prior art devices require shipment and storage in a flat condition, involving expensive crating and handling. Also, prior art electric mat switches required substantial hand work in manufacture to maintain the several layers properly positioned during assembly. The prior art presented further difficulties in that the separator layer was spaced inward from the sealed edge margin and therefore free to shift and dislocate or fold the foil sheets; or if the separator layer was secured to the margin then by its porous nature the moisture seal was often lost or reduced resulting in deterioration and shorting of the switch.

Representative of the prior art of which applicant is aware are the below listed patents:

| U.S. Pat. No. | PATENTEE |
|---|---|
| 3,243,540 | Miller |
| 3,754,176 | Miller |
| 4,137,116 | Miller |
| 4,200,777 | Miller |

SUMMARY OF THE INVENTION

The present invention is concerned with an electric mat switch of the type described which overcomes the above mentioned difficulties of the prior art, providing a highly durable and reliable construction which is adapted to be rolled for compactness and economy in storage and shipping without deleterious effects; can be economically produced in substantially any shape and size; permits of substantial automation in manufacture to reduce labor costs while resulting in a mat switch of improved quality, reliability in operation and resistance to deterioration from moisture.

It is another object of the present invention to provide an electric mat switch construction having the advantageous characteristics mentioned in the preceding paragraph which is capable of manufacture by radio frequency welding and to achieve the advantages thereof, including heavier wear layers, better hermetic sealing, and accurately controlled sensitivity without premature damage by excessive or abusive conditions of use.

It is still another object of the present invention to provide an electric mat switch of the type described which is capable of use with a variety of electrical circuits for accomodation to existing or newly installed equipment.

Other objects of the present invention will become apparent upon reading the following specification and referring to the accompanying drawings, which form a material part of this disclosure.

The invention accordingly consists in the features of construction, combinations of elements, and arrangements of parts, which will be exemplified in the construction hereinafter described, and of which the scope will be indicated by the appended claims.

BRIEF DESCRIPTION OF THE DRAWINGS

FIG. 1 is a top perspective view showing a typical electric mat switch of the present invention.

FIG. 2 is a partial sectional elevational view taken generally along the line 2—2 of FIG. 1.

FIG. 3 is an exploded perspective view showing the elements of FIG. 2.

DESCRIPTION OF THE PREFERRED EMBODIMENT

Referring now more particularly to the drawings, and particularly to FIG. 1 thereof, a mat switch is there generally designated 10, being shown for purposes of illustration and without limiting intent, as being of generally rectangular configuration. Of course, the mat 10 may be of any desired configuration. If employed on the floor about a machine tool, the mat configuration may be determined by that of the machine tool; or, several mats may be employed simultaneously in adjacent relation to achieve a required configuration, if desired. Extending from the mat switch 10 may be an electrical conduit 11 electrically connecting internal conductors in the mat switch to electric circuitry, as for starting or stopping a machine, opening, closing or stopping a door, or other desired actuating characteristic.

The switch is shown in greater detail in FIGS. 2 and 3. It will there be seen that a pair of generally congruent, relatively thick outer layers 15 and 16 are superposed in facing spaced relation. The outer layers are flexible and wear-resistant, advantageously being fabricated of thermally weldable material, such as polyvinyl chloride, for sealing by heat or radio frequency welding. In particular, the lower outer wear layer 15 may be provided in its upper or inner surface with a grid or array of internal ribs 17, preferably having their surfaces smoothly curved, as at 18.

The upper, outer wear layer 16 is also advantageously flexible and of a thermally weldable composition, such as polyvinyl chloride, for heat sealability and radio frequency welding. The upper, outer wear layer 16 may be relatively thick, as compared to the lower outer wear layer 15, for longevity in resisting scuffing and abrasion by boots, shoes, vehicles and the like. The upper outer surface of the upper outer wear member 15 may be provided with integral ribs or wear resistant formations 19 to aid in affording traction to users while increasing the useful life of the product. It will be apparent that the internal ribs 17 of lower wear layer 15 and the external ribs 19 of upper wear layer 16 all extend in the same direction, which facilitates rolling or coiling of a mat about an axis parallel to the ribs.

Interposed between the generally congruent, outer wear layers 15 and 16, are a pair of facing spaced moisture barrier layers 22 and 23, congruent to each other and the outer wear layers. The moisture or vapor barrier layers 22 and 23 are relatively thin, being on the order of 0.008 inches thick, while the lower and upper outer wear layers 15 and 16 are on the order of $\frac{1}{8}$ inch thick and ¼ inch thick, respectively, including their ribs 17 and 19. The moisture or vapor barrier layers 22 and 23 are also advantageously fabricated of polyvinyl chloride.

A medial, separator layer 25 is interposed between the vapor barrier layers 22 and 23, being substantially congruent with the vapor barrier and outer wear layers 15 and 16. Thus, the separator layer 25, vapor barrier layers 22 and 23 and outer wear layers 15 and 16 may all be substantially coextensive with each other. In addition, the separator layer 25 is flexible and resiliently, highly compressible, for a purpose appearing presently. Polyvinyl chloride foam has been found highly advantageous for use in the separator layer 25; and, an open or reticulated configuration is preferred, say having a plurality of regularly spaced through holes or apertures 26.

The separator layer 25 may be formed of foam sheeting of approximately 1/16 inch thick and configured congruent to the several layers 15, 16, 22 and 23.

The separator layer 25 has its peripheral margin 27 sandwiched between the peripheral margins of the vapor barrier layers 22 and 23, and of the outer wear layers 15 and 16. This sandwiching of the peripheral margins is achieved by welding, preferably radio frequency welding under compression of the several layers of similar composition. By this welding, the separator layer 25 is compressed to an extremely thin, impervious layer, as by compressing out and removing the pores of the foam. The marginal, peripheral welded region 30 is thereby effectively sealed to prevent the passage therethrough of gases or vapors, to define a hermetic, peripheral seal.

On opposite sides of the separator layer 25, interposed between the latter and respective vapor barriers 22 and 23 are conductor layers 32 and 33, as of aluminum or metallic foil. These conductor layers 32 and 33 are electrically connected to conductor wires for exit from the mat switch 10 through conduit 11, so that the conductor layers 32 and 33 define contacts of the mat switch.

Suitably laminated to the outer surfaces of each conductor layer 32 and 33 is a bulking layer, as at 34 and 35, respectively, which layers may be congruent to and coextensive with their respective conductor layers. The bulking layers 34 and 35 may be of fiberglass fabric, or other suitable material, and thermally laminated or adhesively secured in intimate contact with the entire outer surface of the respective conductor layer. The conductor layers 32 and 33, together with their bulking layers 34 and 35 may be configured similar to, but smaller than the congruent layers 15, 16, 22, 23 and 25. Thus, the conductor layers 32 and 33, and their associated bulking layers 34 and 35 terminate at their bounding edges short of the bounding edges of the layers 15, 16, 22, 23 and 25, and short of the peripheral weld region 30.

In assembly it has been found advantageous to locate the conductor layers 32 and 33 in proper position with respect to the layers 15, 16, 22, 23 and 25 before formation of the weld 30. Toward this end, adhesive tapes 37 and 38 may secure the conductor layers 32 and 33 on the inner surfaces of respective vapor barrier layers 22 and 23. If preferred, the bulking layers 34 and 35 may be positioned directly to the vapor barriers 22 and 23 by adhesive, with or without the tapes 37 and 38.

However, after assembly and welding together of the several layers 15, 16, 22, 23 and 25, the condition shown in FIG. 2, the spacer layer 25 serves to effectively retain the conductor layers 32 and 33 in proper location and without folding, crimping or other untoward deformation, even under rolling, handling and the like under conditions of storage and transit.

By reason of the intimate lamination of bulking layers 34 and 35 to foil conductor layers 32 and 33, it will be appreciated that creasing, dimpling or other permanent deformation of the foil is effectively prevented, even under the impact of sharp objects and heavily concentrated loads. While heat sealing of the margin 30 is a possibility, radio frequency welding is preferred, both for its greater reliability in effecting a hermetic seal, and its possible use with greater thicknesses of material. As the several layers 15, 16, 22, 23 and 25 may all be of the same essential material, preferably polyvinyl chloride, it is seen that simultaneous welding of all superposed layers may be readily achieved. The internal ribs 17 serve to further assure protuberance through the separator openings 26 of conductor layers 32 and 33 into contact with each other, while the smooth rib surfaces prevent deformation of the conductor layers.

From the foregoing, it is seen that the present invention provides an electric mat switch which fully accomplishes its intended objects and is well adapted to meet practical conditions of manufacture, insulation and use.

Although the present invention has been described in some detail by way of illustration and example for purposes of clarity of understanding, it is understood that certain changes and modifications may be made within the spirit of the invention.

What is claimed is:

1. An electric mat switch comprising a pair of facing spaced generally congruent flexible outer wear layers fabricated of weldable material, a pair of facing spaced flexible inner moisture barrier layers between and generally congruent to said outer wear layers and fabricated of weldable material, a pair of facing spaced flexible conductor layers between said moisture barrier layers generally similar to and smaller than said moisture barrier layers and spaced inwardly from the margins thereof, and a resiliently compressible apertured separator layer of weldable material interposed between said conductor layers and generally congruent to said moisture barrier and wear layers; the overlying margins of said wear layers, moisture barrier layers and separator layer being welded together to locate and retain each conductor layer between the separator layer and a respective moisture barrier layer.

2. An electric mat switch according to claim 1, said wear layers, moisture barrier layers and separator layer being radio frequency welded together.

3. An electric mat switch according to claim 1, in combination with a bulking layer generally congruent to and laminated with each conductor layer on the nonfacing side thereof, to resist deformation of said conductor layers under concentrated impact.

4. An electric mat switch according to claim 3, said bulking layers being fabricated of fiberglass cloth.

5. An electric mat switch according to claim 1, said wear layers, moisture barrier layers and separator layer being fabricated of polyvinyl chloride for simultaneous welding of said layers.

6. An electric mat switch according to claim 1, one of said wear layers having external ribs for traction, and the other of said wear layers having internal ribs for enhanced conductor layer contact through said separator layer.

7. An electric mat switch according to claim 6, said internal ribs being relatively smooth to prevent permanent deformation of said conductor layers.

8. An electric mat switch according to claim 1, said separator layer being fabricated of porous foam and being compressed in the weld to remove its pores and seal said margins.

9. An electric mat switch according to claim 8, said wear layers, moisture barrier layers and separator layer being radio frequency welded together.

10. An electric mat switch according to claim 8, said wear layers, moisture barrier layers and separator layer being fabricated of polyvinyl chloride for simultaneous welding of said layers.

11. An electric mat switch according to claim 8, one of said wear layers having external ribs for traction, and the other of said wear layers having relatively smooth internal ribs for enhanced conductor layer contact through said separator layer without permanent deformation of said conductor layers.

12. An electric mat switch according to claim 6, said external and internal ribs extending longitudinally of each other, to facilitate mat flexure.

* * * * *